US006081966A

United States Patent [19]

Antekeier et al.

[11] Patent Number: 6,081,966

[45] Date of Patent: Jul. 4, 2000

[54] SELF-CENTERING ROLLER HINGE UNIT FOR A ROLL-UP DOOR

[75] Inventors: Steve A. Antekeier; Jerry G. Miller, both of Norton Shores, Mich.

[73] Assignee: Fleet Engineers, Incorporated, Muskegon, Mich.

[21] Appl. No.: 09/232,301

[22] Filed: Jan. 15, 1999

Related U.S. Application Data

[60] Provisional application No. 60/071,533, Jan. 15, 1998.

[51] Int. Cl.[7] ..... A47H 15/00

[52] U.S. Cl. ..... 16/91; 16/106; 160/201

[58] Field of Search ..... 160/196.1, 199, 160/201, 206, 207; 16/91, 106, 87 R, 107

[56] References Cited

U.S. PATENT DOCUMENTS

| | | | |
|---|---|---|---|
| 1,974,147 | 9/1934 | Bittorf . | |
| 2,233,351 | 2/1941 | Rowe . | |
| 3,140,508 | 7/1964 | Switzgable . | |
| 4,120,072 | 10/1978 | Hormann | 160/201 X |
| 4,205,713 | 6/1980 | Galbreath . | |
| 4,379,479 | 4/1983 | Whiting . | |
| 4,924,932 | 5/1990 | Esnault | 160/201 |

OTHER PUBLICATIONS

Access Works, Inc., 1995 Catalog entitled "Roll–Up Doors and Replacement Parts".

*Primary Examiner*—Jerry Redman

*Attorney, Agent, or Firm*—Rader, Fishman, Grauer & Mc Garry, An Office of Rader Fishman & Grauer PLLC

[57] ABSTRACT

A hinge and roller assembly for use in a roll-up door including a pair of leaves each forming a portion of a bearing socket, a bushing mounted in the bearing socket, a shaft slidably mounted in the bushing. The shaft mounts a roller on one end and the roller is adapted to roll in a track. A spring is mounted between the shaft and the bushing to bias the shaft axially toward the track. A releasable retainer on the bushing removably retains the bushing in the socket. Preferably, each of the leaves includes a plate through which the hinge is mounted to the door and an integral strap which is bent into a circular shape to define a portion of the socket and is attached at a distal end to the plate.

13 Claims, 2 Drawing Sheets

SELF-CENTERING ROLLER HINGE UNIT FOR A ROLL-UP DOOR

CROSS-REFERENCE TO RELATED APPLICATION

This application claims the benefit of U.S. provisional patent application Ser. No. 60/071,533, filed Jan. 15, 1998.

BACKGROUND OF THE INVENTION

1. Field of the Invention

This invention relates to an improved roller hinge unit for an articulated rollup door and, more particularly, to a roller hinge unit including a spring for centering the articulated roll-up door.

2. Description of the Related Art

Truck doors of the type commonly referred to as roll-up or upwardly acting conventionally employ multiple door sections which are hinged together, with each door section being rollably supported on a pair of L-shaped tracks for low friction upward movement from a substantially vertical closed position into a substantially horizontal open position. Each door section has a roller hinge unit disposed adjacent the side edges thereof, which units not only hinge the adjacent door sections for relative pivoting movement therebetween, but additionally support a roller shaft which mounts a roller that rolls on the stationery L-shaped track. The U.S. Pat. No. 2,257,513 shows such a construction, for example.

The roller hinge unit conventionally employs a pair of hinge leaves fixed to the adjacent door sections and disposed in juxtaposed relationship. The hinge leaves support and form a hinge socket in which a roller shaft axially slides to compensate for track variation. The stem has a roller on a distal end thereof for rolling on the adjacent track.

One recent roller hinge unit has a bushing with a closed end that mounts a spring to bias the stem of the roller outwardly. The bushing is retained in the hinge by fingers which form the socket for the bushing. The fingers are bent into a semi-cylindrical shape to form the bushing socket after the socket has been positioned in the hinge. The fingers must be pliable to bend and are supported on one end only. This construction results in a tweak hinge because the fingers can deform under stress and the socket can fall out of the socket.

SUMMARY OF THE INVENTION

According to the invention, a hinge and roller assembly for use in a roll-up door includes a pair of leaves each forming a portion of a bearing socket, a bushing mounted in the bearing socket, and a shaft slidably mounted in the bushing. The shaft mounts a roller on one end and the roller rolls in a track. A spring is mounted between the shaft and the bushing to bias the shaft axially toward the track. A releasable retainer on the bushing removably retains the bushing in the socket. Preferably, each of the leaves include a plate through which the hinge is mounted to the door and an integral strap, which is bent into a circular shape to define a portion of the socket and is attached at a distal end to the plate.

In one embodiment of the hinge and roller assembly, the bushing includes a collar at a first end which abuts a first end of the socket and a groove at a second end adjacent the second end of the socket, and the retainer is a split ring mounted in the groove and abuts the second end of the socket.

In another embodiment, the bushing includes a collar at a first end of the bushing and an integrally formed finger at an end portion of the bushing. The collar abuts a first end of the socket, the integrally formed finger has a retaining tab on an end portion thereof and abutting a second end of the socket, and the integrally formed finger is deflectable inwardly for sliding assembly of the bushing into the socket. Preferably, the retaining tab includes a ramped surface for aiding insertion of the bushing into the socket. In one version, a U-shaped slot in the bushing defines the integrally formed finger. In another version, an axial slot in the bushing defines the integrally formed finger.

For each embodiment, a spring biases the roller assembly axially outward from the bushing. In one embodiment, the bushing includes a closed end adjacent to the second end of the bushing and the spring is mounted in the closed end of the bushing. In another embodiment, the spring is mounted between the socket and the roller.

BRIEF DESCRIPTION OF THE DRAWINGS

The invention will now be described with reference to the drawings in which.

DETAILED DESCRIPTION OF THE PREFERRED EMBODIMENTS

Figure 1:
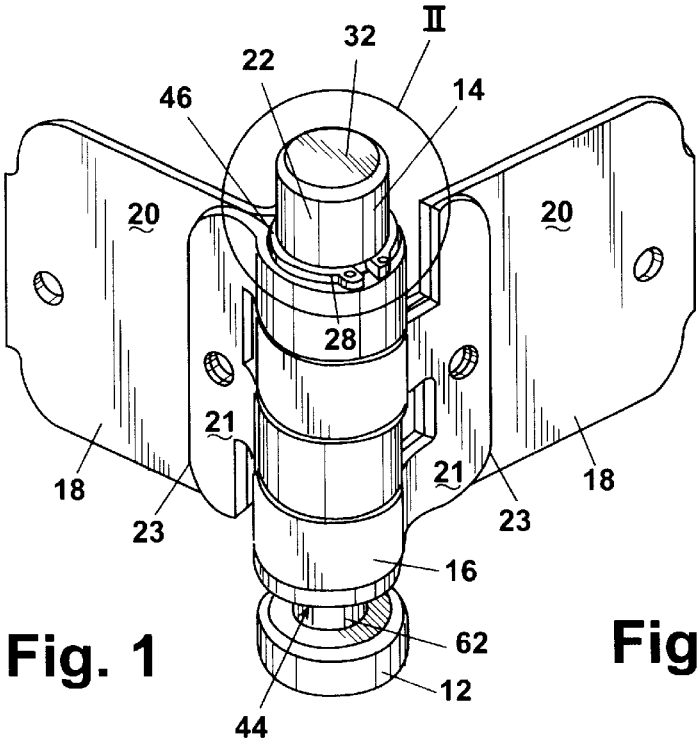
FIG. 1 is a perspective view of a roller hinge assembly according to a first embodiment of the invention.

Referring now to the drawings, a self-centering roller hinge assembly includes a roller assembly 9 comprising a roller 12 and a shaft 10, which is rotatably received within a tubular self-lubricating bushing 14 releasably retained in a socket 16 formed a by mated leaves 18 comprising a hinge. The shaft 10, roller 12 and bushing 14 pivotably support the leaves 18, which together pivotably mount adjacent panels (not shown) for a roll-up cargo door. The bushing 14 is retained in the socket 16 by a releasable retainer according to the invention.

The hinge is pre-formed of mated leaves 18 defining the socket 16 for sliding reception of the bushing 14 and roller 12 coaxially therein. Each of the leaves 18 includes a plate 20 through which the hinge is mounted to the door and an integral strap 21 that is bent into a circular shape to define a portion of the socket 16 and is attached at a distal end 23 to the plate 20.

Figure 1A:
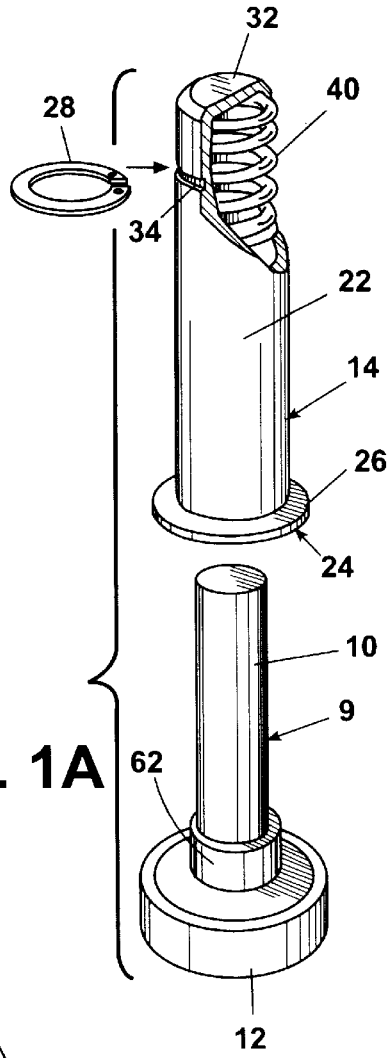
Figure 2:
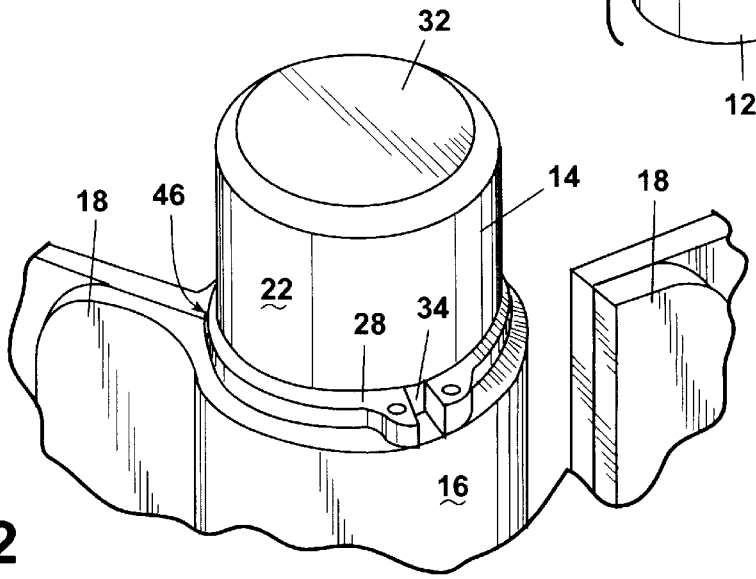
FIG. 2 is an enlarged partial perspective view of a portion of the roller hinge unit shown in FIG. 1.

A first embodiment is shown in FIGS. 1, 1A, and 2, where the socket 16 defined by the leaves 18 receives a self-lubricating bushing 14 positioned co-axially within the socket 16 formed by the mated integral straps 21 at the distal ends of the hinge leaves 18. The bushing 14 includes an outer surface 22 of uniform diameter and is retained in the pre-formed hinge socket 16 at an open first end 24 by a collar 26 and at a second end 32 by a releasable retainer, specifically a split ring 28 seated in a groove 34. Further, the closed second end 32 seats a spring 40, as best shown in FIG 1A, for biasing the shaft 10 of the roller 12 outwardly from the hinge socket 16. As best illustrated in FIG. 1A, the split ring 28 is received in an annular groove 34 formed on the circumferential periphery of the bushing 14. When the ring 28 is seated in the groove 34, the bushing 14 is restrained against axial movement in the hinge socket 16 by the ring 28 and the collar 26, but is free to rotate therein.

To assemble, a pre-formed hinge 20 having the mated hinge leaves 18 forming the socket 16 receives coaxially therein the bushing 14. The bushing 14 is inserted until the collar 26 abuts a first end 44 of the socket 16, which exposes the annular groove 34 adjacent a second end 46 of the socket 16. The split ring 28 is then seated in the groove 34 restraining the bushing 14 against axial movement, while leaving it free to rotate within the socket 16. Next, a spring (not shown) is inserted through the open first end of the bushing 14 and slid therein until it abuts the closed second end 32. Then, a distal end of the shaft 10 is inserted into the bushing 14 so that the spring biases the shaft 10, and thus the attached roller 12, outwardly from the hinge 20.

Figure 3:
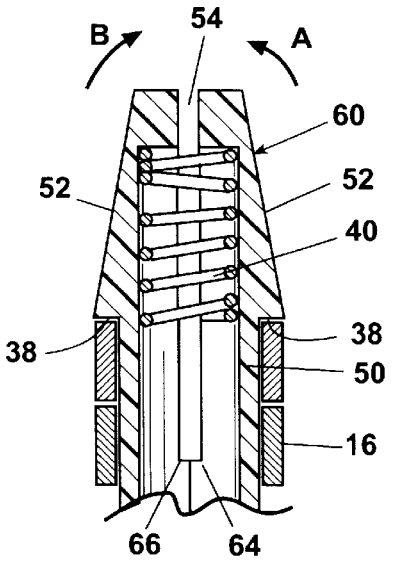
FIG. 3 is a partial sectional view of a second embodiment according to the invention.

A variation of a roller hinge assembly with a releasable retainer is shown in FIG. 3. Specifically, a tubular self-lubricating bushing 50 includes a pair of integrally formed deflectable fingers. The deflectable fingers include ramp surfaces 52 at a first end 60, as well as a slot 54 cut axially therethrough, and an open end (not shown) opposite the first end 60.

When the bushing 50 is inserted into the socket 16, the interior of the preformed hinge socket 16 presses the ramped surfaces 52 towards one another, thereby closing the slot 34. More specifically, the ramped surfaces 52 flex at points 64 and 66 in the direction of arrows A and B so as to narrow the outside diameter of the bushing 50 at its first end 60. The bushing 50 is slid through the socket 16 until the ramped surfaces 52 pass by the distal end 46 of the socket 16, at which point they return to their natural or rest position. The widest point of the ramped surfaces 52 forms an abutment 38, which, together with a collar adjacent the open end (not shown), similar to that shown in the previous embodiment, restrain the bushing 50 against axial movement in the socket 16 once the bushing 50 is fully inserted. The bushing 50 remains free to rotate within the socket 16. Next, a spring 40 is inserted in the bushing 50 through the open end (not shown) and slid to the first end 60, followed by the distal end of the shaft 10 mounting a roller 12, as was described for the first embodiment.

Figure 4:
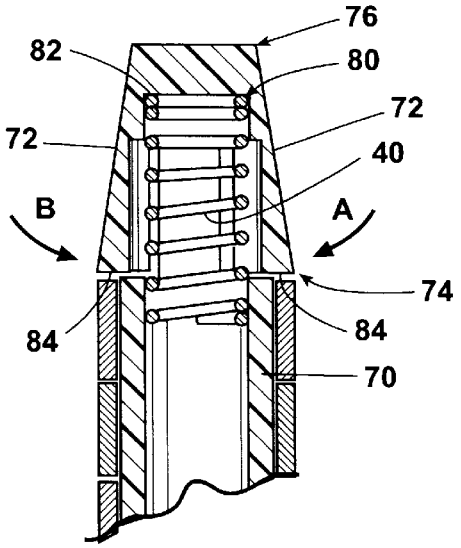
FIG. 4 is a partial sectional view of a third embodiment according to the invention.

A further embodiment of a roller hinge assembly with a releasable retainer, shown best in FIG. 4, includes a tubular self-lubricating bushing 70 includes a pair of integrally formed deflectable fingers at a first end 76. The deflectable fingers include ramped surfaces 72 defined by a U-shaped slot. The ramped surfaces 72 facilitate the insertion of the self-lubricating bushing 70 into the hinge socket 16. An open end (not shown) opposite the first end 76 receives the shaft 10 of the roller 12.

The bushing 70 is inserted through the hinge socket 16 by forcing the narrow end 76 through the socket 16, thereby exerting pressure on the ramped surfaces 72 in the direction of arrows A and B such that the ramped surfaces 72 flex inwardly at points 80 and 82. Once the bushing 70 is inserted fully, the wide end 74 resumes its natural rest position, thereby providing an abutment 84 to axially restrain the bushing 70 within the hinge socket 16 together with a collar on the open end of the bushing 70, similar to that shown for the first embodiment. Once the bushing 70 has been inserted and restrained within the socket 16, the spring 40 is inserted, followed by the distal end of the shaft 10 mounting the roller 12.

Figure 4A:
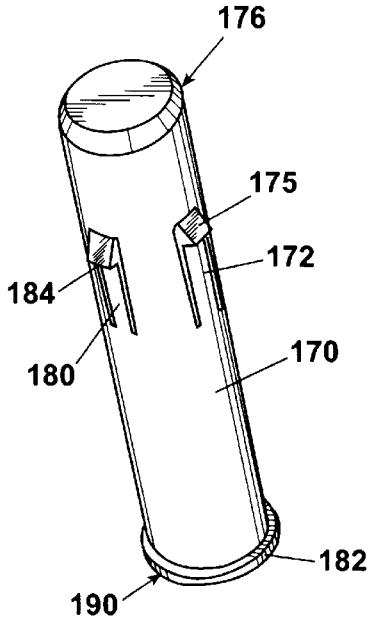

As shown in FIG. 4A, another embodiment of a roller hinge assembly with a releasable retainer includes a tubular self-lubricating bushing 170 with multiple integrally formed deflectable fingers 172. Each deflectable finger 172 includes a ramped surface 175 having a shoulder 184 intermediate a first end 176 to facilitate the insertion of the self-lubricating bushing 170 into the hinge socket 16. The second end is an open end 190 opposite the first end 176. Preferably, the deflectable fingers 172 are equidistantly spaced and aligned circumferentially about the periphery of the bushing 170. While four deflectable fingers 172 are preferred, more or less deflectable fingers 172 can be used.

The bushing 170 is inserted through the hinge socket 16 by sliding the first end 176 through the socket 16, and exerting pressure on the ramped surfaces 175 in the direction of arrows A and B whereby the ramped surfaces 172 flex inwardly at points 180. Once the bushing 170 is inserted fully, the deflectable fingers 172 resume their natural rest position, whereby the shoulder 184 abuts the distal end of the hinge strap 21 to axially restrain the bushing 170 within the hinge socket 16 together with a collar 182 on the open end of the bushing 170, similar to that shown for the first embodiment. Once the bushing 170 has been inserted and restrained within the socket 16, the spring 40 is inserted, followed by the distal end of the shaft 10 mounting the roller 12.

Figure 5:
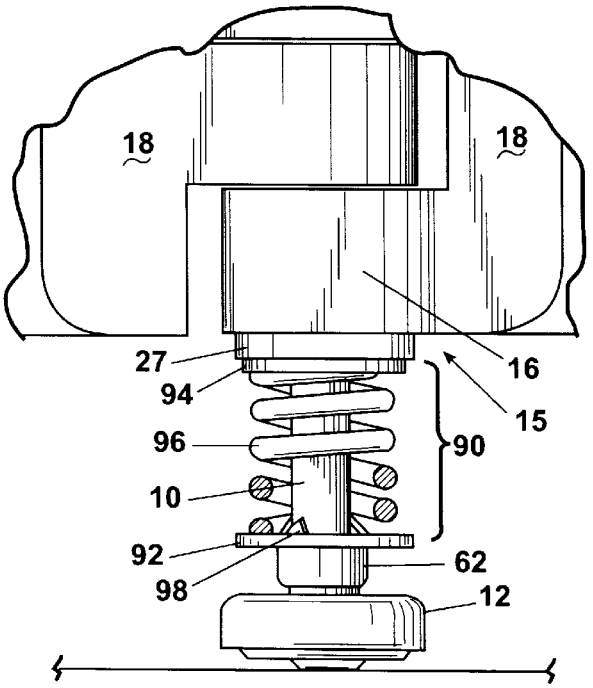
FIG. 5 is a partial front elevational view of a fourth embodiment according to the invention.

Another embodiment of a roller hinge assembly with a releasable retainer includes a tubular bushing 15 mounted in the hinge socket 16 by any suitable fastening method, including those methods discussed above. The bushing 15 may be a conventional metal bushing, or self-lubricating as employed for the other embodiments. As shown in FIG. 5, the shaft 10 receives a spring assembly 90 between the roller 12 and the bushing 15. The spring assembly 90 includes annular washers 92 and 94 at each end of the spring 96. The washer 92 has barbs 98 that bear against the shaft 10 to prevent movement of the washer 92 toward the free end of the shaft 10.

The bushing 15 includes a collar 27, which, in this embodiment, abuts the washer 94 of the spring assembly 90. The washer 92 is coaxial with the shaft 10 and adjacent a shoulder 62 on the shaft 10. The spring 96 is compressed between the washers 92 and 94 as the shaft 10 moves axially in the socket 16.

To assemble, the bushing 15 is inserted into the socket 16 of a pre-formed hinge 20 and the spring assembly 90 is slid over the distal end of the shaft 10. The shaft 10, having the spring assembly 90 mounted thereon, is then inserted into the bushing 15 such that the spring assembly 90 is mounted on the shaft IO between the collar 27 on the bushing 15 and the shoulder 62 on the shaft 10.

When using any of the embodiment of the invention, the spring 40, 90 biases the shaft 10 and the roller 12 outwardly of the bushing 14, 15, thus centering the rollup up cargo door to which multiple roller hinge units are attached.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure and drawings without departing from the scope of the invention which is defined in the appended claims.

What is claimed is:

1. A hinge and roller assembly for use in a roll-up door, comprising:

a pair of leaves each forming a portion of a bearing socket;

a bushing mounted in the bearing socket;

a shaft slidably mounted in the bushing, the shaft mounting a roller on one end, the roller adapted to roll in a track;

a spring mounted between the shaft and the bushing to bias the shaft axially with respect to the bushing toward the roller; and a releasable retainer on the bushing for removably retaining the bushing in the bearing socket.

2. A hinge and roller assembly according to claim 1 wherein each of the leaves include a plate through which the hinge is adapted to be mounted to the door and an integral strap which is bent into a circular shape to define a portion of the socket and is attached at a distal end to the plate.

3. A hinge and roller assembly according to claim 1 wherein the spring is mounted between the socket and the roller.

4. A hinge and roller assembly according to claim 1 wherein the bushing includes a collar at a first end which abuts a first end of the socket and a groove at a second end adjacent the second end of the socket, and the retainer is a split ring mounted in the groove and abutting the second end of the socket.

5. A hinge and roller assembly according to claim 4 wherein the bushing includes a closed end adjacent to the second end of the bushing and the spring is mounted in the closed end of the bushing.

6. A hinge and roller assembly according to claim 4 wherein the spring is mounted between the first end of the socket and the roller.

7. A hinge and roller assembly according to claim 1 wherein the bushing includes a collar at a first end of the bushing and an integrally formed finger at an end portion of the bushing, the collar abutting a first end of the socket, the integrally formed finger having a retaining tab on an end portion thereof and abutting a second end of the socket, the integrally formed finger being deflectable inwardly for sliding assembly of the bushing into the socket.

8. A hinge and roller assembly according to claim 7 wherein the spring is mounted between the first end of the socket and the roller.

9. A hinge and roller assembly according to claim 7 wherein the retaining tab includes a ramped surface for aiding insertion of the bushing into the socket.

10. A hinge and roller assembly according to claim 7 wherein the integrally formed finger is defined by a U-shaped slot in the bushing.

11. A hinge and roller assembly according to claim 10 wherein the bushing includes a closed end adjacent to the second end of the bushing and the spring is mounted in the closed end of the bushing.

12. A hinge and roller assembly according to claim 7 wherein the integrally formed finger is defined by an axial slot in the bushing.

13. A hinge and roller assembly according to claim 12 wherein the bushing includes a substantially closed end adjacent to the second end of the bushing and the spring is mounted in the substantially closed end of the bushing.

* * * * *